United States Patent [19]

Balsavage et al.

[11] Patent Number: 4,825,743

[45] Date of Patent: May 2, 1989

[54] MAGAZINE AND FEED MECHANISM FOR FIREARMS

[75] Inventors: Walter Balsavage, 222 Tantum Dr., Trenton, N.J. 08610; Floyd O. Aikman, Piedmont, Ala.

[73] Assignee: Walter Balsavage, Trenton, N.J.

[21] Appl. No.: 191,942

[22] Filed: May 9, 1988

[51] Int. Cl.[4] ..... F41C 25/04

[52] U.S. Cl. ..... 89/33.1; 42/9; 89/33.17

[58] Field of Search ..... 89/33.1, 33.2; 42/9

[56] References Cited

U.S. PATENT DOCUMENTS

| | | | |
|---|---|---|---|
| 1,218,458 | 3/1917 | Polite | 89/11 |
| 1,322,053 | 11/1919 | Reising | 89/144 |
| 2,358,792 | 9/1944 | Conway | 42/18 |
| 2,359,517 | 10/1944 | Gebean | 89/135 |
| 2,448,081 | 8/1948 | Conway | 42/17 |
| 2,624,241 | 1/1953 | Hill | 89/33.17 |
| 2,773,325 | 12/1956 | Hill | 42/50 |
| 2,791,855 | 5/1957 | Simmons | 42/17 |
| 2,882,635 | 4/1959 | Hill | 42/17 |
| 3,125,821 | 3/1964 | Ruger et al. | 42/17 |
| 3,142,921 | 8/1964 | Ruger | 42/17 |
| 3,901,123 | 8/1975 | Jayne et al. | 89/33.2 |
| 3,997,994 | 12/1976 | Kastner et al. | 42/9 |
| 4,004,363 | 1/1977 | Sackenreuter et al. | 42/9 |
| 4,152,857 | 5/1979 | Ketterer | 42/9 |
| 4,286,499 | 9/1981 | Gillum | 89/33.1 |
| 4,336,742 | 6/1982 | Bourlet | 42/50 |
| 4,348,941 | 9/1982 | Ketterer et al. | 42/9 |
| 4,492,144 | 1/1985 | Dix | 89/33.17 |
| 4,524,672 | 6/1985 | Balsavage | 89/33.1 |

FOREIGN PATENT DOCUMENTS

| | | |
|---|---|---|
| 73513 | 8/1944 | Czechoslovakia . |
| 432448 | 8/1926 | Fed. Rep. of Germany . |
| 1137350 | 9/1962 | Fed. Rep. of Germany . |
| 541792 | 10/1973 | Switzerland . |
| 5564 | of 1881 | United Kingdom . |
| 10944 | of 1884 | United Kingdom . |
| 573658 | 11/1945 | United Kingdom . |

*Primary Examiner*—David H. Brown

*Attorney, Agent, or Firm*—Sperry, Zoda & Kane

[57] ABSTRACT

An improved magazine and feed mechanism is disclosed for firearms which provides a transfer disc for receiving cartridges laterally with respect to the barrel of the firearm such as to be rotatable to orient the cartridge longitudinally with respect to the barrel. The transfer disc is positioned above the bolt and the bolt includes abutting means for contacting a cartridge defined within the slot in the transfer disc and urging same downwardly into the barrel. Continuous positive engagement of rotation of the transfer disc resulting from movement of the bolt is achieved. A cartridge injector head is included having a flat spring biasing device which cooperates with a cartridge injector to remove cartridges from the magazine for placement into the slot of the transfer disc.

16 Claims, 3 Drawing Sheets

MAGAZINE AND FEED MECHANISM FOR FIREARMS

BACKGROUND OF THE INVENTION

1. Field Of The Invention

The present invention relates generally to the field of firearms and in particular to those types of firearms utilizing cartridges fed from a magazine while being disposed transversely to the axis of the barrel of the weapon. Conventionally the cartridges are rotated 90 degrees to thereby be in a position such that they are aligned with the barrel ready for discharge.

2. Description Of The Prior Art

Examples of devices patented heretofore in this field of art include U.S. Pat. No. 4,524,672 issued June 25, 1985 to W. Balsavage on a Magazine and Feed Mechanism For Firearms; and U.S. Pat. No. 1,218,458 patented Mar. 6, 1917 to W. Polite on a Gun; U.S. Pat. No. 1,322,053 patented Nov. 18, 1919 to E. G. Reising on a firearm; U.S. Pat. No. 2,358,792 patented Sept. 26, 1944 to W. Conway on a Firearm U.S. Pat. No. 2,359,517 patented Oct. 3, 1944 to R. D. Gebeau on a Simplified Artillery Mechanism; U.S. Pat. No. 2,448,081 patented Aug. 31, 1948 to W. B. Conway on an Automatic Ammunition Feed For Firearms; U.S. Pat. No. 2,624,241 patented Jan. 6, 1953 to J. Hill on Gun Action; U.S. Pat. No. 2,773,325 patented Dec. 11, 1956 to J. Hill on a Magazine And Cartridge Container Assembly; U.S. Pat. No. 2,791,855 patented May 14, 1957 to E. Simmons on a Shell Carrier Mechanism For Automatic Shotguns; U.S. Pat. No. 2,882,635 patented Apr. 21, 1959 to J. Hill on a Tubular Combined Cartridge Container And Magazine Unit; U.S. Pat. No. 3,125,821 patented Mar. 24, 1964 to W. Ruger et al on a Repeating Gun With Cartridge Lifter And Cartridge Stop Member; U.S. Pat. No. 3,142,921 patented Aug. 4, 1964 to W. Ruger on a Cartridge Lifter Mechanism For Semi-Automatic Gun; U.S. Pat. No. 3,997,994 patented Dec. 21, 1976 to G. Kastner et al on a Shoulder Arm With Swivel Breech Member; U.S. Pat. No. 4,004,363 Rotatable Cartridge Chamber For Firearm Type Weapon; U.S. Pat. No. 4,152,857 patented May 8, 1979 to D. Ketterer on a Means For Loading Small Firearms Including A Box Magazine And Cartridge Clips; U.S. Pat. No. 4,286,499 patented Sept. 1, 1981 to F. Gillum on a Cross Axis Shell Feeding Apparatus For Firearms; U.S. Pat. No. 4,336,742 patented June 29, 1982 to M. Bourlet on a Loader For Machine-Pistol And Similar; British Specification No. 573,658 of Nov. 30, 1945 to L. Blacker on Improvements In Or Relating To Apparatus For Throwing Bombs, Grenades And Like Projectiles Or Missiles; British Specification No. 10,944 of Aug. 5, 1884 to C. Bate on Improvements in Fire-Arms; British Specification No. 5564 of Dec. 20, 1881 to W. Stringfellow on Improvements In Revolving Fire-Arms; German Pat. No. 432448 of Aug. 4, 1926; German Pat. No. 1 137 350 of Sept. 27, 1962; Switzerland Pat. No. 541 792 of Oct. 31, 1973 and Czechoslovakia Pat. No. 73513 of 1944.

SUMMARY OF THE INVENTION

The present invention provides an improved magazine and feed mechanism usable on firearms which conventionally include a housing defining a barrel extending longitudinally therethrough and a magazine mounted thereon adapted to hold a plurality of cartridges in position extending laterally with respect to the housing and positioned in such a manner as to be movable from the magazine outwardly through a cartridge outlet therein.

A transfer disc is rotatably mounted within the housing and defines a cartridge receiving slot therein for receiving individually removed cartridges from the magazine while oriented laterally one at a time. The transfer disc is rotatable between a laterally oriented cartridge receiving position and a longitudinally oriented cartridge supplying position. An actuating arm is pivotally secured with respect to the transfer disc and is slidably movable within the housing between a retracted position with the cartridge receiving slot in the laterally oriented cartridge receiving position and an advanced position with the cartridge receiving slot oriented in the longitudinally oriented cartridge supplying position.

A bolt member is longitudinally movable within the housing and is operatively engaged with respect to the actuating arm to urge movement thereof to the retracted position responsive to movement of the bolt member to the rearward position away from the barrel and movement thereof to the forward position responsive to movement of the bolt member to the forward position adjacent the barrel.

A flat spring means is included which defines a slot centrally therein. This flat spring means is preferably fixedly secured with respect to the magazine adjacent to the cartridge outlet thereof in such a manner as to resiliently bias the most advanced cartridge into the magazine. A transfer disc receiving station will be positioned adjacent to the flat spring of the magazine in such a manner as to be capable of receiving cartridges oriented laterally therefrom. The transfer disc receiving station allows the transfer disc to be rotatable in position above the longitudinally extending axis of the barrel and also above the longitudinal path of movement of the bolt member in order to provide a more positive capability for cartridge movement and to minimize the longitudinal length of the firearm.

A cartridge injector is pivotally secured with respect to the housing adjacent the magazine and normally thereabove. This cartridge injector is movable between a retracted position and an injection position. The cartridge injector may include a cartridge injector head adapted to selectively extend through the slot defined in the flat spring means responsive to the cartridge injector means moving toward the injection position to urge a cartridge from retainment within the magazine into the laterally extending cartridge receiving slot of the transfer disc. A cartridge injector linkage will also be secured with respect to the cartridge injector and operatively attached with respect to the bolt member to urge movement of the cartridge injector head through the injection position when the actuator arm is in the retracted position with the cartridge receiving slot in the laterally oriented cartridge receiving position. A cartridge loading means will be movable with the bolt member and be adapted to contact the rear edge of a cartridge positioned within the cartridge receiving slot when the transfer disc is in the cartridge supplying position and is adapted to urge the cartridge to move into the adjacently positioned rear end of the barrel upon movement of the bolt member to the forward position adjacent the barrel.

An injector biasing device such as a spring will be positioned between the housing and the cartridge injector to facilitate pivotal movement of the cartridge injector from the injection position back to the retracted position.

A cartridge catch may be included pivotally mounted with respect to the transfer disc immediately adjacent to the cartridge receiving slot defined therein. This cartridge catch will be resiliently biased inwardly toward the cartridge receiving slot and be adapted to abut a cartridge positioned therein to exert bias thereagainst to facilitate retainment of the cartridge within the slot. Preferably the abutting surface will be arcuate.

A catch spring will preferably be also positioned between the cartridge catch and the transfer disc to thereby urge the cartridge catch to exert bias upon a cartridge located within the cartridge receiving slot there adjacent. Furthermore the cartridge catch will preferably include an ejector tab extending downwardly therefrom adapted to be contacted by the bolt member as moved longitudinally toward the forward position adjacent the barrel to facilitate ejection of the cartridge downwardly and forwardly from the cartridge receiving slots into abutting engagement with the bolt member to thereby facilitate placement of the cartridge into the barrel.

The bolt means preferably will include an injector lug defined thereon which is adapted to engage the cartridge injector linkage to facilitate control of movement of the cartridge injection device. Preferably the cartridge injector linkage will include a slot means defined therein adapted to receive the injector lug.

The magazine may preferably include a roller means therein to facilitate movement of cartridges therein toward the cartridge outlet. To facilitate securement of the magazine with respect to the housing the housing will preferably define magazine mounting slots and the magazine will include magazine mounting lugs adapted to extend into the magazine mounting slots to facilitate mounting thereof with respect to the housing.

To facilitate securement of the transfer disc during movement of a cartridge therein a locking notch may be defined in the upper surface thereof and a locking wedge member may be fixedly secured with respect to the cartridge injector means. Upon movement of the cartridge injector downwardly the locking wedge member will be adapted to extend into the locking notch thereby forming a fixed engagement between the cartridge injector and the transfer disc to facilitate placement of the cartridge into the receiving slot.

It is an object of the present invention to provide an improved magazine and feed mechanism for firearms wherein initial capitol outlay is minimized.

It is an object of the present invention to provide an improved magazine and feed mechanism for firearms wherein maintenance costs are minimized.

It is an object of the present invention to provide an improved magazine and feed mechanism for firearms wherein overall firearm length is minimized by placement of the transfer disc above the path of movement of the bolt.

It is an object of the present invention to provide an improved magazine and feed mechanism for firearms wherein weight is minimized.

It is an object of the present invention to provide an improved magazine and feed mechanism for firearms wherein the amount of material used for the firearm is minimized.

It is an object of the present invention to provide an improved magazine and feed mechanism for firearms wherein a transfer disc is movable through 90 degrees by complete positive engagement with respect to a bolt rather than requiring any biasing means to return the transfer disc to the steady state position.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
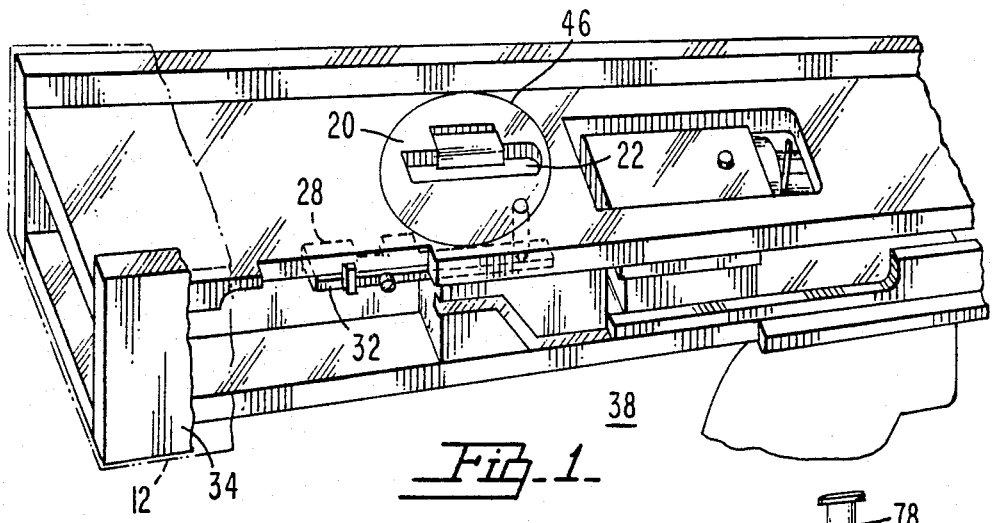
FIG. 1 is an embodiment of the improved magazine and feed mechanism for firearms of the present invention shown in perspective.
Figure 2:
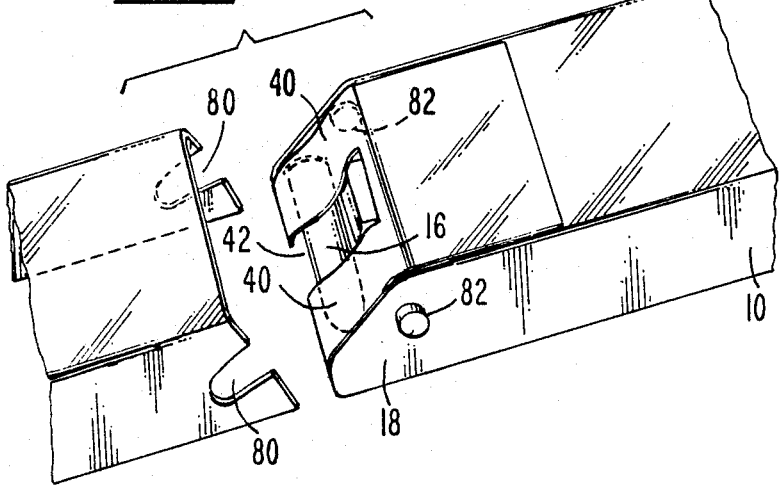
FIG. 2 is an embodiment of the interlocking lug and slot configuration for fixedly mounting of a magazine with respect to the housing of the firearms.
Figure 3:
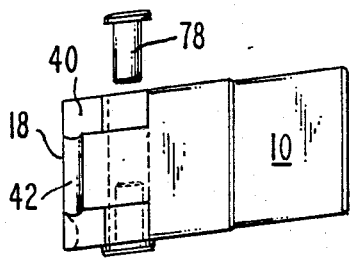
FIG. 3 is a top plan view of an embodiment of the magazine of the present invention utilizing roller means therein.
Figure 4:
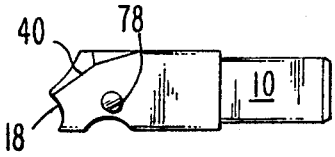
FIG. 4 is a side plan view of the embodiment shown in FIG. 3.
Figure 5:
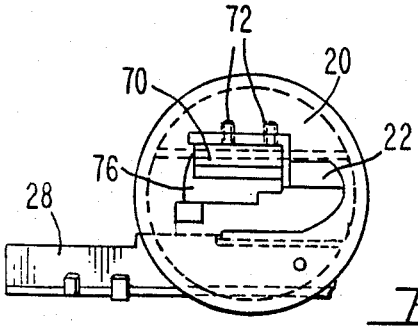
FIG. 5 is a top plan view of an embodiment of the transfer disc, cartridge catch means and actuator arm of the present invention.
Figure 6:
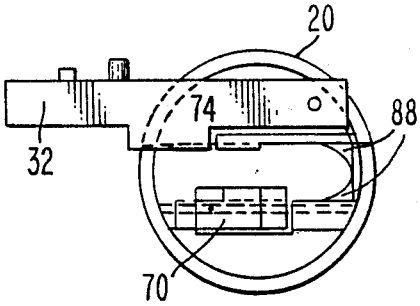
FIG. 6 is a bottom plan view of the embodiment shown in FIG. 5.
Figure 7:
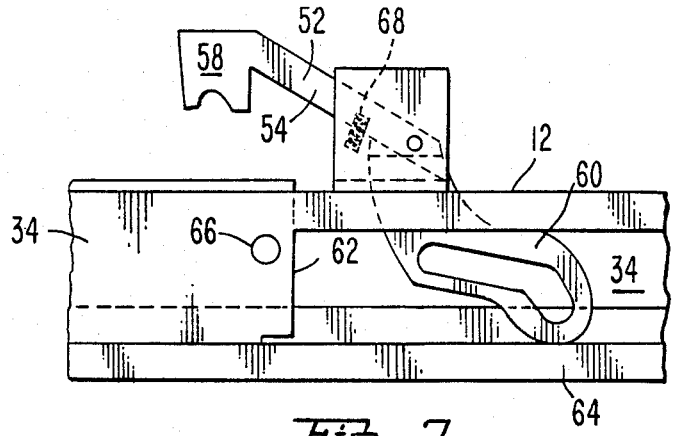
FIG. 7 is a side plan view of an embodiment of the bolt, cartridge injector and housing of the present invention.
Figure 8:
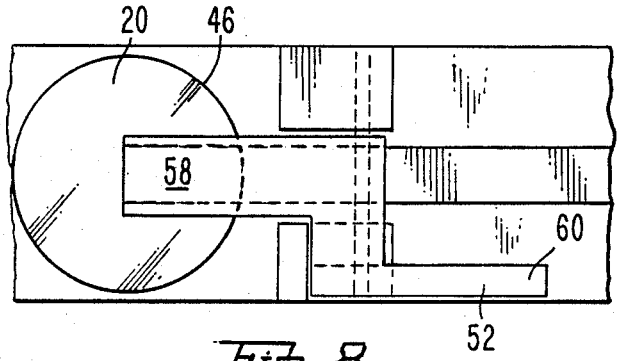
FIG. 8 is a top plan view of the embodiment shown in FIG. 7.
Figure 9:
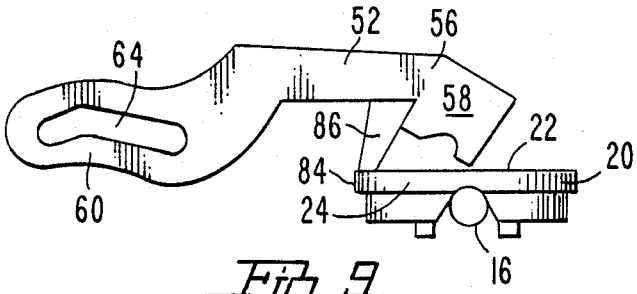
FIG. 9 is a side plan view illustrating an embodiment of the cartridge injector, wedge means and transfer disc of the present invention.
Figure 10:
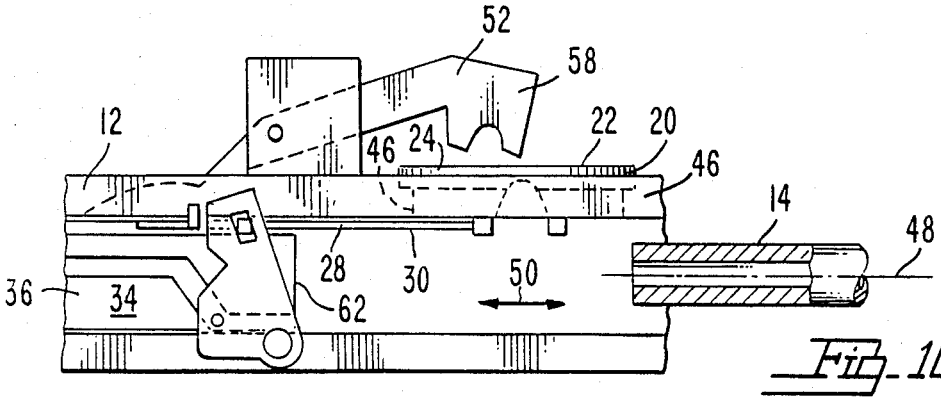
FIG. 10 is a side plan view of an embodiment of a feed mechanism of the present invention.
Figure 11:
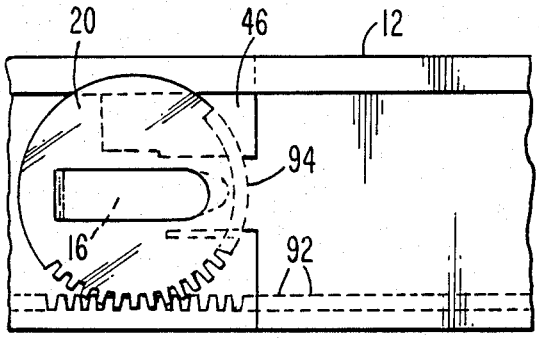
FIG. 11 is a top plan view of an alternative embodiment of the drive means for the transfer disc.
Figure 12:
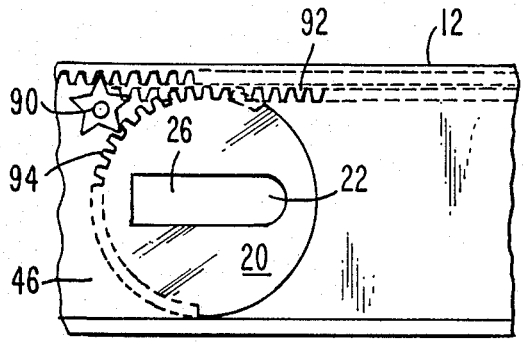
FIG. 12 is another alternative embodiment of the positive engaging rotation means for the transfer disc of the present invention.

The present invention provides a novel magazine and feed mechanism for firearms which is adapted to receive cartridges 16 from a magazine 10 to facilitate ultimately mounting within position in a barrel 14 for discharge thereof.

Magazine 10 defines a cartridge outlet 18 adjacent one end thereof. A transfer disc 20 is mounted within a transfer disc receiving station 46 defined in the housing 12 of the firearm. Transfer disc 20 is movable through 90 degrees. Transfer disc 20 will define a cartridge receiving slot 22 therein.

Cartridge receiving slot 22 is rotatable from a cartridge receiving position 24 extending laterally with respect to the magazine 10 and a cartridge supplying position 26 extending longitudinally with respect to the magazine 10 and the barrel 14.

An actuating arm 28 is pivotally mounted with respect to housing 12 between a retracted position 30 and an advanced position 32. When in the advanced position 32 the actuating arm 28 will be adapted to urge a cartridge 16 to be removed from the cartridge outlet 18 of magazine 10 for placement into the cartridge receiving slot 22.

A bolt member 34 is mounted within housing 12 and is movable between a rearward position 36 and a forward position 38. The bolt means is operatively connected with respect to the actuator arm 28. Movement of the bolt member 34 to the forward position 38 will cause movement of the actuator arm 28 to the advanced position 32. In a similar manner movement of bolt member 34 to the rearward position 36 will cause movement of actuator arm 28 to the retracted position 30.

When actuator arm 28 is in the retracted position 38 the cartridge receiving slot 22 will be in the cartridge receiving position 24. Similarly when the actuator arm 28 is in the advanced position 32 the cartridge receiving slot 22 will be in the cartridge supplying position 26. As bolt member 34 is moved forwardly a cartridge loading means defined thereon will be adapted to contact the rear edge of the cartridge 16 positioned within the cartridge receiving slot 22 for movement thereof into the barrel 14.

Removal of cartridge 16 from the magazine 10 will be facilitated by a flat spring biasing means 40 which may be integral with the magazine and extends outwardly thereof across at least a portion of the slot means 42 defined therein. The cartridge injector means 52 is movable between a retracted position 54 and an injection position 56. Cartridge injector 52 includes a cartridge injection head 58 which is adapted to extend through slot means 42 and pushed downwardly on the forwardmost positioned cartridge 16 such that the force of the flat spring biasing means 40 is overcome and the cartridge is dropped outwardly therefrom to fall into the cartridge receiving slot 22 therebelow. In this position the cartridge 16 will be oriented perpendicular to the axis 48 of barrel 14. The bolt member 34 will then be moved forwardly along movement path 50. The actuator arm 28 will thereby be caused to move toward the advanced position 32 causing rotation of transfer disc 20 and movement of the cartridge 16 and the cartridge receiving slot 22 into the cartridge supplying position 26. In this position the cartridge 16 is able to be contacted by bolt member 36 and specifically by cartridge loading means 62 in such a manner as to urge the cartridge into the barrel 14 position thereadjacent.

Positive movement of the bolt member 34 with respect to the cartridge injector 52 will be made possible through cartridge injector linkage means 60. This linkage 60 may define a linkage slot 64 therein which is adapted to be entered by injector lug means 66 responsive to movement of bolt member 34 through the bolt movement path 50. With this coordination of movement the movement of bolt member 34 will coordinate rotation of transfer disc 20 with movement of cartridge injector 52.

To facilitate return of the cartridge injector 52 to the retracted position 54 an injector biasing means 68 such as a spring means or the like may be included.

To further facilitate retainment of the cartridge 16 in position within the cartridge receiving slot 22 a cartridge catch means 70 may be included. Preferably the cartridge catch 70 will abut the cartridge when in the slot 22 and will include an arcuate abutment surface 76 to facilitate this engagement. A resilient spring biasing means 72 may be included to add further bias of the cartridge catch 70 against the cartridge 16. An injector catch 74 may extend downwardly therefrom in order to be contacted by the bolt member 34 or a member attached with respect thereto to facilitate release of the cartridge downwardly from the transfer disc 20 when desired.

A roller means 78 may be included within the magazine 10 to facilitate movement of cartridges therethrough toward the cartridge outlet 18 defined therein. Mounting of magazine 10 with respect to housing 12 is facilitated by defining magazine mounting slots in housing 12 and by defining complementary magazine mounting lugs 82 on the magazine. This will greatly facilitate engagement between the magazine 10 and the housing 12.

A locking notch means 84 may be defined in the upper surface of the transfer disc 20 and a locking wedge member 86 may be fixedly secured with respect to the cartridge injector or specifically the cartridge injector head 58 in such a manner that locking engagement of the transfer disc 20 will be achieved during injection movement of a cartridge 18 downwardly into the slot 22 defined therein.

To facilitate movement of the cartridge 16 from the slot 22 downwardly into the barrel 14 a flared lower section 88 may be included slightly enlarging the lateral dimension of the slot throughout the section.

Positive engagement between the movement of the bolt and the 90 degree rotation of the transfer disc is an important aspect of the present invention. To achieve this engagement an alternative configuration can include a bolt gearing means 92 and a transfer disc gearing means 94 which are adapted to engage with respect to one another such that movement of the transfer disc will be achieved by continuous positive engagement with respect to the bolt 34. Such a configuration can also utilize intervening gear means 90 as desired in order to achieve the overall positive engaging control.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In an improved magazine and feed mechanism for firearms having a housing defining a barrel extending longitudinally therealong, a magazine mounted thereon being adapted to hold a plurality of cartridges extending laterally with respect to the housing and positioned to be urged from the magazine in successively following order outwardly through a cartridge outlet defined therein, a transfer disc rotatably mounted within the housing and defining a cartridge receiving slot adapted to receive successive cartridges oriented laterally one at a time from the magazine positioned thereadjacent, the transfer disc being rotatable between a laterally oriented cartridge receiving position and a longitudinally oriented cartridge supplying position, a transfer disc actuating arm pivotally secured with respect to the transfer disc and slidably movable in the housing between a retracted position with the cartridge receiving slot in the laterally oriented cartridge receiving position and an advanced position with the cartridge receiving slot oriented in the longitudinally oriented cartridge supplying position, a bolt member longitudinally movable within the housing and being operatively engageable with the actuating arm to cause movement thereof to the retracted position responsive to movement of the bolt member to the rearward position away from the barrel and movement thereof to the forward position responsive to movement of the bolt member to the forward position adjacent the barrel, the improvement which comprises:

(a) a flat spring biasing means defining a slot means therein and being fixedly secured with respect to the magazine adjacent the cartridge outlet thereof to resiliently bias the most advanced cartridge into the magazine;

(b) a transfer disc receiving station positioned within the housing and adapted to rotatably retain the transfer disc above the longitudinally extending axis of the barrel and above the longitudinal path of movement of the bolt member to provide a more positive cartridge movement and to minimize the longitudinal length of the firearm;

(c) a cartridge injector means pivotally secured with respect to the housing adjacent the magazine and movable between a retracted position and an injection position, said cartridge injector means further including:

(1) a cartridge injector head adapted to selectively extend through said slot means defined in said flat spring biasing means responsive to said cartridge injector means moving toward the injection position to urge a cartridge from retainment within the magazine into the laterally extending cartridge receiving slot of the transfer disc;

(2) a cartridge injector linkage means secured with respect to said cartridge injector means and operatively attached with respect to the bolt member to urge movement of said cartridge injector head to the injection position when the actuator arm is in the retracted position with the cartridge receiving slot in the laterally oriented cartridge receiving position; and (3) a cartridge loading means movable with the bolt member and adapted to contact the rear edge of a cartridge positioned within the cartridge receiving slot when the transfer disc is in the cartridge supplying position and adapted to urge the cartridge to move into the adjacently positioned rear end of the barrel upon movement of the bolt member to the forward position adjacent the barrel.

2. In an improved magazine and feed mechanism for firearms the improvement as defined in claim 1 further comprising an injector biasing means positioned between the housing and said cartridge injector means to facilitate pivotal movement of the cartridge injector means from the injection position to the retracted position.

3. In an improved magazine and feed mechanism for firearms the improvement as defined in claim 1 wherein said flat spring biasing means is integral with respect to the magazine.

4. In an improved magazine and feed mechanism for firearms the improvement as defined in claim 1 wherein the magazine includes roller means therein to facilitate movement of cartridges therein toward the cartridge outlet defined therein.

5. In an improved magazine and feed mechanism for firearms, the improvement as defined in claim 1 wherein the housing defines magazine mounting slots and the magazine includes magazine mounting lugs adapted to extend into said magazine mounting slots to facilitate mounting of the magazine with respect to the housing.

6. In an improved magazine and feed mechanism for firearms the improvement as defined in claim 1 further including a locking notch means defined in the upper surface of the transfer disc and a locking wedge member fixedly secured with respect to said cartridge injector means and adapted to engage with said locking notch means responsive to said cartridge injector means being in the injection position to facilitate retainment of the transfer disc in the cartridge receiving position responsive to said cartridge injector means being in the injection position.

7. In an improved magazine and feed mechanism for firearms the improvement as defined in claim 1 wherein the cartridge receiving slot defines a flared lower section adapted to facilitate movement of a cartridge downwardly and forwardly toward the barrel.

8. In an improved magazine and feed mechanism for firearms the improvement as defined in claim 1 further comprising intervening gear means engaged with respect to said transfer disc gearing means and said bolt gearing means to facilitate operative engagement therebetween.

9. In an improved magazine and feed mechanism for firearms the improvement as defined in claim 1 wherein the bolt means includes an injector lug means thereon adapted to engage said cartridge injector linkage means to facilitate control of movement of said cartridge injection means.

10. In an improved magazine and feed mechanism for firearms the improvement as defined in claim 9 wherein said cartridge injector linkage means defines linkage slot means therein adapted to receive said injector lug means to further facilitate control of movement of said cartridge injection means.

11. In an improved magazine and feed mechanism for firearms the improvement as defined in claim 1 further comprising a cartridge catch means pivotally mounted with respect to the transfer disc adjacent the cartridge receiving slot therein, said cartridge catch means being resiliently biased inwardly toward the cartridge receiving slot and adapted to abut a cartridge positioned therein to exert bias thereagainst to facilitate retainment thereof within the cartridge receiving slot.

12. In an improved magazine and feed mechanism for firearms the improvement as defined in claim 11 further including catch spring means positioned between said cartridge catch means and the transfer disc to urge said cartridge catch means to exert bias upon a cartridge located within the cartridge receiving slot.

13. In an improved magazine and feed mechanism for firearms the improvement as defined in claim 11 wherein said cartridge catch means includes an ejector tab extending downwardly therefrom being adapted to be contacted by the bolt member as moved longitudinally toward the forward position adjacent the barrel to facilitate ejection of a cartridge downwardly and forwardly from the cartridge receiving slot into abutting engagement with the bolt member to facilitate placement of the cartridge into the barrel.

14. In an improved magazine and feed mechanism for firearms the improvement as defined in claim 11 wherein said cartridge catch means includes an arcuate abutment surface to facilitate retainment of a cartridge within the cartridge receiving slot.

15. In an improved magazine and feed mechanism for firearms having a housing defining a barrel extending longitudinally therealong, a magazine mounted thereon being adapted to hold a plurality of cartridges extending laterally with respect to the housing and positioned to be urged from the magazine in successively following order outwardly through a cartridge outlet defined therein, a transfer disc rotatably mounted within the housing and defining a cartridge receiving slot adapted to receive successive cartridges oriented laterally one at a time from the magazine positioned thereadjacent, the transfer disc being rotatable between a laterally oriented cartridge receiving position and a longitudinally oriented cartridge supplying position, a transfer disc actuating arm pivotally secured with respect to the transfer disc and slidably movable in the housing between a retracted position with the cartridge receiving slot in the laterally oriented cartridge receiving position and an advanced position with the cartridge receiving slot oriented in the longitudinally oriented cartridge supplying position, a bolt member longitudinally movable within the housing and being operatively engageable with the actuating arm to cause movement thereof to the retracted position responsive to movement of the bolt member to the rearward position away from the barrel and movement thereof to the forward position responsive to movement of the bolt member to the forward position adjacent the barrel, the improvement which comprises:

(a) a cartridge catch means pivotally mounted with respect to the transfer disc adjacent the cartridge receiving slot therein, said cartridge catch means further including:
  (1) resilient biasing means biased inwardly toward the cartridge receiving slot and adapted to abut a cartridge positioned therein to force bias thereagainst to facilitate retainment;
  (2) an ejector tab adapted to be abutted by the bolt member as it is moved longitudinally toward the forward position adjacent the barrel to facilitate ejection of a cartridge downwardly and forwardly from the cartridge receiving slot into abutting engagement with the bolt member to facilitate placement of the cartridge into the barrel;
  (3) an arcuate abutment surface adapted to contact a cartridge within the cartridge receiving slot to facilitate retainment thereof;
(b) catch spring means positioned between said cartridge catch means and the transfer disc to urge said cartridge catch means to exert bias upon a cartridge located within the cartridge receiving slot;
(c) a flat spring biasing means defining a slot means therein and being integral with respect to the magazine adjacent the cartridge outlet thereof to resiliently bias the most advanced cartridge into the magazine;
(d) a transfer disc receiving station positioned within the housing and adapted to rotatably retain the transfer disc above the longitudinally extending axis of the barrel and above the longitudinal path of movement of the bolt member to provide a more positive cartridge movement and to minimize the longitudinal length of the firearm;
(e) a cartridge injector means pivotally secured with respect to the housing adjacent the magazine and movable between a retracted position and an injection position to feed cartridges from the magazine to the transfer disc, said cartridge injector means further including:
  (1) a cartridge injector head adapted to selectively extend through said slot means defined in said flat spring biasing means responsive to said cartridge injector means moving toward the injection position to urge a cartridge from retainment within the magazine into the laterally extending cartridge receiving slot of the transfer disc;
  (2) a cartridge injector linkage means secured with respect to said cartridge injector means and operatively attached with respect to the bolt member to urge movement of said cartridge injector head to the injection position when the actuator arm is in the retracted position with the cartridge receiving slot in the laterally oriented cartridge receiving position, said cartridge injector linkage means includes linkage slot means to facilitate control;
  (3) a cartridge loading means movable with the bolt member and adapted to contact the rear edge of a cartridge positioned within the cartridge receiving slot when the transfer disc is in the cartridge supplying position and adapted to urge the cartridge to move into the adjacently positioned rear end of the barrel upon movement of the bolt member to the forward position adjacent the barrel;
(f) an injector biasing means positioned between the housing and said cartridge injector means to facilitate pivotal movement of the cartridge injector means from the injection position to the retracted position;
(g) an injector lug means fixedly secured with respect to the bolt member to be movable therewith and being adapted to engage said linkage slot means of said cartridge injector linkage means responsive to movement of the bolt member to facilitate control of movement of said cartridge injector means;
(h) roller means rotatably positioned within the magazine to facilitate movement of cartridges therein toward the cartridge outlet;
(i) magazine mounting slots defined in the housing;
(j) magazine mounting lugs fixedly secured with respect to the magazine and being adapted to extend into said magazine mounting slots to facilitate mounting of the magazine with respect to the housing; and
(k) a flared lower section defined by the transfer disc adjacent the forwardmost end of the cartridge receiving slot to facilitate movement of a cartridge therefrom toward the barrel.

16. In an improved magazine and feed mechanism for firearms having a housing defining a barrel extending longitudinally therealong, a magazine mounted thereon being adapted to hold a plurality of cartridges extending laterally with respect to the housing and positioned to be urged from the magazine in successively following order outwardly through a cartridge outlet defined therein, a transfer disc rotatably mounted within the housing and defining a cartridge receiving slot adapted to receive successive cartridges oriented laterally one at a time from the magazine positioned thereadjacent, the transfer disc being rotatable between a laterally oriented cartridge receiving position and a longitudinally oriented cartridge supplying position, a bolt member longitudinally movable within the housing between a forward position adjacent the barrel to a rearward position spatially disposed away from the barrel, the improvement which comprises:

(a) a flat spring biasing means defining a slot means therein and being fixedly secured with respect to the magazine adjacent the cartridge outlet thereof to resiliently bias the most advanced cartridge into the magazine;

(b) a transfer disc receiving station positioned within the housing and adapted to rotatably retain the transfer disc above the longitudinally extending axis of the barrel and above the longitudinal path of movement of the bolt member to provide a more positive cartridge movement and to minimize the longitudinal length of the firearm;

(c) a transfer disc gearing means being fixedly secured with respect to the transfer disc;

(d) a bolt gearing means being fixedly secured with respect to the bolt member and operatively engaged with respect to said transfer disc gearing means to control movement of the transfer disc, said bolt member being operative when in the rearward position to urge the transfer disc to the cartridge receiving position and operative when in the forward position to urge the transfer disc to the cartridge supplying position;

(e) a cartridge injector means pivotally secured with respect to the housing adjacent the magazine and movable between a retracted position and an injection position, said cartridge injector means further including:

(1) a cartridge injector head adapted to selectively extend through said slot means defined in said flat spring biasing means responsive to said cartridge injector means moving toward the injection position to urge a cartridge from retainment within the magazine into the laterally extending cartridge receiving slot of the transfer disc;

(2) a cartridge injector linkage means secured with respect to said cartridge injector means and operatively attached with respect to the bolt member to urge movement of said cartridge injector head to the injection position when the actuator arm is in the retracted position with the cartridge receiving slot in the laterally oriented cartridge receiving position; and (3) a cartridge loading means movable with the bolt member and adapted to contact the rear edge of a cartridge positioned within the cartridge receiving slot when the transfer disc is in the cartridge supplying position and adapted to urge the cartridge to move into the adjacently positioned rear end of the barrel upon movement of the bolt member to the forward position adjacent the barrel.

* * * * *